United States Patent [19]

Huckle

[11] Patent Number: 4,597,340

[45] Date of Patent: Jul. 1, 1986

[54] SECURE CONTAINER

[75] Inventor: Ralph E. Huckle, West Sussex, England

[73] Assignee: De La Rue Systems Limited, Portsmouth, England

[21] Appl. No.: 552,963

[22] Filed: Nov. 17, 1983

[30] Foreign Application Priority Data

Nov. 19, 1982 [GB] United Kingdom ..... 8233107

[51] Int. Cl.[4] ..... E05G 1/00; B65H 1/08

[52] U.S. Cl. ..... 109/45; 109/52; 70/63; 221/227

[58] Field of Search ..... 109/19, 45, 47, 49.5, 109/58.5, 59, 63.5, 66, 73; 70/63; 312/191, 211, 212; 271/149, 150, 160, 162–164; 221/226, 227, 198, 279

[56] References Cited

U.S. PATENT DOCUMENTS

| | | | |
|---|---|---|---|
| 4,113,140 | 9/1978 | Graef et al. | 221/227 |
| 4,134,520 | 1/1979 | Collins et al. | 221/227 |
| 4,186,977 | 2/1980 | Gilovizh et al. | 109/52 |
| 4,341,100 | 7/1982 | Kohlhage | 70/63 |

FOREIGN PATENT DOCUMENTS

| | | | |
|---|---|---|---|
| 454599 | 7/1968 | Switzerland | 221/226 |
| 2039264 | 8/1980 | United Kingdom . | |

*Primary Examiner*—Thomas J. Holko
*Assistant Examiner*—Neill Wilson
*Attorney, Agent, or Firm*—Cushman, Darby & Cushman

[57] ABSTRACT

A secure container, for example a portable cassette for banknotes, has a shutter at one end movable by a sliding shutter bar (2). The shutter is lockable by the action of a shutter locking bar (8) pivoted at its center between a locking position (as shown in FIG. 1) and a primed position at which the shutter locking bar is parallel to the container walls and its end is aligned with an aperture 2*a* in the shutter bar (2) allowing the shutter bar to slide within the container and open the shutter.

The shutter locking bar (8) is moved to its primed position by a lock (5) with a rotatable lock pin (6) engaging an operating arm (7) coupled to the shutter locking bar (8). An interlock pawl (11) pivotally mounted on a flange of the arm (7) has a catch engaging the lock pin (6), so as to prevent improper priming of the shutter locking bar (8) until the operation of the lock (5).

12 Claims, 7 Drawing Figures

SECURE CONTAINER

The present invention relates to a secure container for example for handling sheets such as banknotes having a high intrinsic value, and is especially applicable to portable banknote cassettes for use in integrated money handling systems, for example cassettes of the type described in UK patent application No. 2039264.

Secure containers used in the past for handling stacks of banknotes have been provided with a shutter at one end for controlling access through an aperture to a stack of banknotes, and a key-operated lock for the shutter. With these previous cassettes it has sometimes been possible for the shutter to be unlocked either by accident, during handling of the cassette, or deliberately by the insertion of some tool into the cassette, without the need to operate the lock.

It is therefore an object of the present invention to provide a secure container whose shutter can be unlocked only by the operation of the said lock.

Moreover, in known cassettes of this type, stacks of banknotes are held in place by means of a packer plate slidable along the length of the container and spring-biased so as to compress the stack against an end wall. With such a construction, it is essential to provide continuous support for the stack during handling of the cassette, and yet to avoid an excessive compressive force on the stack which would inhibit the delivery of individual notes from the end of the stack.

It is therefore a further object of the invention to provide an improved mechanism for packing a stack of banknotes in such a secure container.

The invention consists in a secure container with a shutter for controlling access through an aperture to the contents of the container, and comprising a movable shutter-operating member coupled to the shutter such that insertion of the container into a complementary housing causes the shutter operating member to move within the container and open the shutter, shutter locking means movable between a primed position at which movement of the shutter operating member is allowed, and a locking position at which movement of the shutter operating member is prevented; and a lock with a lock pin cooperating with the shutter locking means and movable between normal and priming positions, movement to the priming position causing the shutter locking means to move to its primed position; and characterized by an interlocking mechanism comprising a first part engaged by the lock pin when the lock pin is in its normal position and a second part connected to the first part and engaging the shutter locking means to prevent the priming of the shutter locking means when the first part is engaged by the lock pin.

In accordance with a further aspect of the invention, a secure, portable, elongate container for banknotes comprises: a secure housing with a floor, side walls, end walls and a lid through which the container is filled with a stack of banknotes, one end wall having a shuttered aperture through which banknotes are dispensed individually; a packer plate assembly slidable lengthwise within the container and spring biased towards the said one end wall, including a packer plate for holding the stack in place, the floor being formed with a regular line of apertures or indentations along the travel path of the packer plate assembly, and the packer plate assembly including a pawl for engaging the said apertures or indentations with a ratchet action as the packer plate assembly slides towards the stack, the pawl being releasable to allow the return movement of the packer plate assembly, the pawl is mounted on the remainder of the packer plate assembly with a degree of play in the lengthwise direction to allow limited return of the packer plate and consequent re-expansion of the stack upon engagement of the pawl in an aperture or indentation.

In order that the invention may be better understood, a preferred embodiment will now be described with reference to the accompanying drawings wherein:

FIG. 1 is a plan view of a portable banknote cassette with the floors and packing plate removed, exposing the locking mechanism which is in the locked condition;

FIG. 2*a* shows the mechanical linkage between the lock and the shutter locking bar of the cassette of FIG. 1, also in plan view;

FIG. 2*b* is an end view of FIG. 2*a*, illustrating the interlocking pawl, the lock pin of the lock, and the mechanical linkage between the lock and the shutter locking bar;

Figure 1:
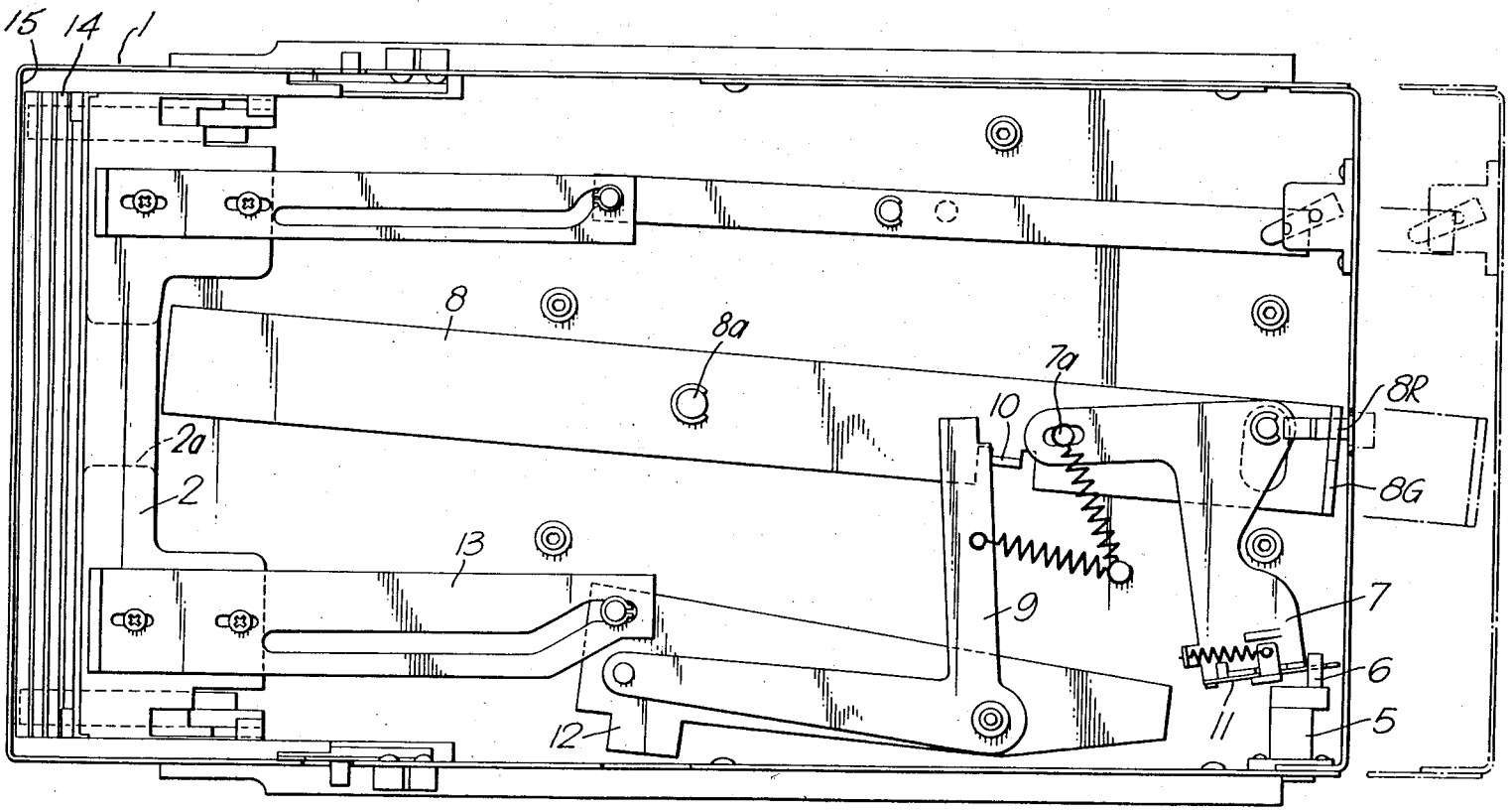

The banknote cassette, shown in FIG. 1, comprises a rectangular metal box with a roller type shutter at one end (the left-hand end in the drawing) coupled to a shutter bar 2. As the shutter bar 2 slides lengthwise within the container, the shutter is opened and closed, as described for example in UK application No. 2039264, referred to above. In this example, the shutter bar has a unitary construction and is biased towards a closed position at the end of the cassette by means of two tension springs. As the cassette is inserted into a complementary housing, two probes extending from the housing are inserted into the cassette and push the shutter bar into the cassette, opening the shutter and allowing access for a feed mechanism to protrude into the cassette and to peel off banknotes as required.

The shutter is locked by means of a shutter locking bar 8 pivoted at a point 8*a* near the middle of its length, one end of which engages the shutter bar 2, and the other end of which is linked to a key-operated lock 5 and to a latch lever 9. With the shutter locking bar 8 in the locking position shown in FIG. 1, its end prevents the movement of the shutter bar, and thus locks the shutter. To prime the cassette in readiness for insertion into the housing, the lock 5 is rotated in an anti-clockwise direction by means of a key and, in a manner which is more fully described later, the lock pin 6 moves a pivoted operating arm 7 in a clockwise direction. The arm 7, by virtue of a pin 7*a* connecting it to the shutter locking bar 8, causes anti-clockwise rotation of the shutter locking bar 8. The shutter locking bar 8 then assumes a position parallel to the walls of the container, and its left-hand end (FIG. 1) is aligned with an aperture 2*a* (shown in dotted lines) in the shutter bar 2, thus allowing the shutter bar 2 to be pushed down the length of the cassette to allow the shutter to open. Simultaneously the latch lever 9 springs into place under the raised catch piece 10 on the locking bar 8.

To provide an indication of the position of the shutter locking bar 8 to an operator, the end of the shutter locking bar opposite to the shutter bar 2 has a red coloured half 8R and a green coloured half 8G, so arranged that the red half appears through a viewing window when the bar is in its locking position (FIG. 1), and the green half is in view when the bar is in its primed position.

As the cassette is subsequently inserted into the housing, the shutter bar 2 is pushed by the probes into the cassette, and a cam plate 13 mounted on the shutter bar causes a side lock arm 12 to pivot outwardly, locking the cassette into the housing. The cam plate 13 also releases the latch lever 9 allowing the bar 8 to lie against the inside wall of the gap in the shutter bar 2 but without impeding the opening movement of the shutter. The primary purpose of the side lock arm 12 is to prevent insertion of the cassette into the dispensing machine housing if the door has been opened by some improper means prior to insertion.

Figure 2A:
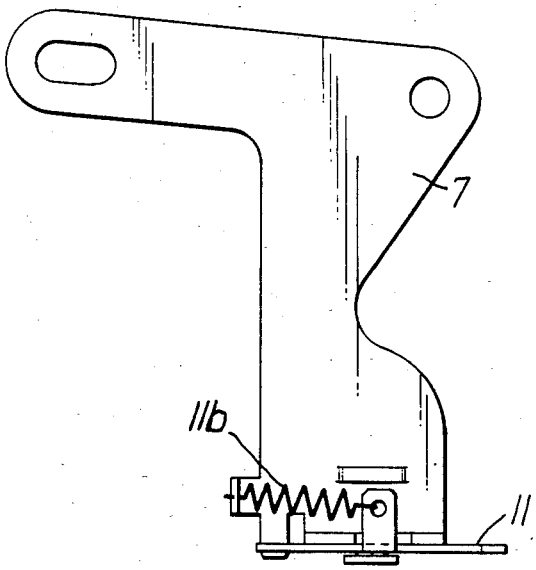
Figure 2B:
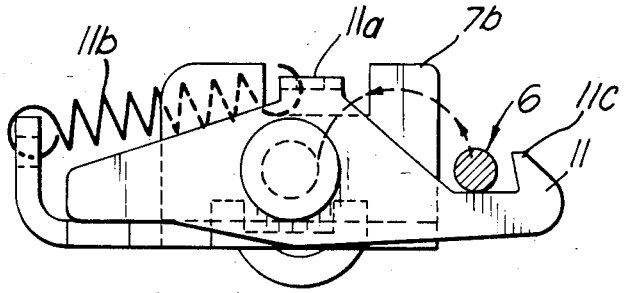

The operating arm 7 provides a mechanical linkage between the lock pin 6 and the shutter locking bar 8, and this arm is shown on an enlarged scale in FIG. 2*a*. FIG. 2*b* is an end view of the operating arm 7, the lock pin 6, and an interlock pawl 11. In the absence of the interlock pawl 11, it may be possible for the shutter locking bar 8 to be moved to its primed position, either accidentally or by means of some tool inserted into the cassette, even though the lock pin 6 is still in its normal position, as shown in FIG. 2*b*. It is the function of the interlock pawl 11 to prevent the movement of the operating arm 7 and shutter locking bar 8 until the lock pin 6 is rotated anti-clockwise (FIG. 2*b*) to prime the shutter locking components in the normal manner.

The interlock pawl 11 is pivoted on an end flange 7*b* of the operating arm 7 about its centre and spring biased (anti-clockwise in FIG. 2*b*) by means of a spring 11*b*. The interlock pawl 11 includes a lug 11*a* which anchors one end of the spring 11*b* and extends through a slot in the flange, and a catch 11*c* for ehgaging the lock pin 6. With the lock pin 6 in its normal position (FIG. 2*b*), the catch on the interlock pawl engages the pin 6 and thus through the lug 11*a* locks the operating arm 7 which then prevents the improper movement of the shutter locking bar 8. Upon movement of the lock pin 6 towards its priming position, as shown by the dotted semi-circle in FIG. 2*b*, the pin 6 moves out of the space between catch 11 and flange 7*b* and pushes the operating arm 7 to the left (FIG. 2*b*). The interlock pawl 11, being mounted on the operating arm 7, travels with the arm 7, relative to the lock. When the shutter locking mechanism has been primed, the key is rotated back in the clockwise direction, returning the lock pin 6 to its normal position before the key is removed from the lock. This time, however, the catch on the interlock pawl 11 is free of the lock pin 6, since the pawl has moved to the left as explained above. Upon the subsequent removal of the cassette from the housing, and the resultant movement of the shutter bar 2 to the shutter-closed position, the operating arm 7 pulls the interlock pawl 11 back to its original position, re-engaging the catch around the lock pin 6 against the force of the spring 11*b*, and moves the shutter locking bar to the position shown in FIG. 1.

Figure 3:
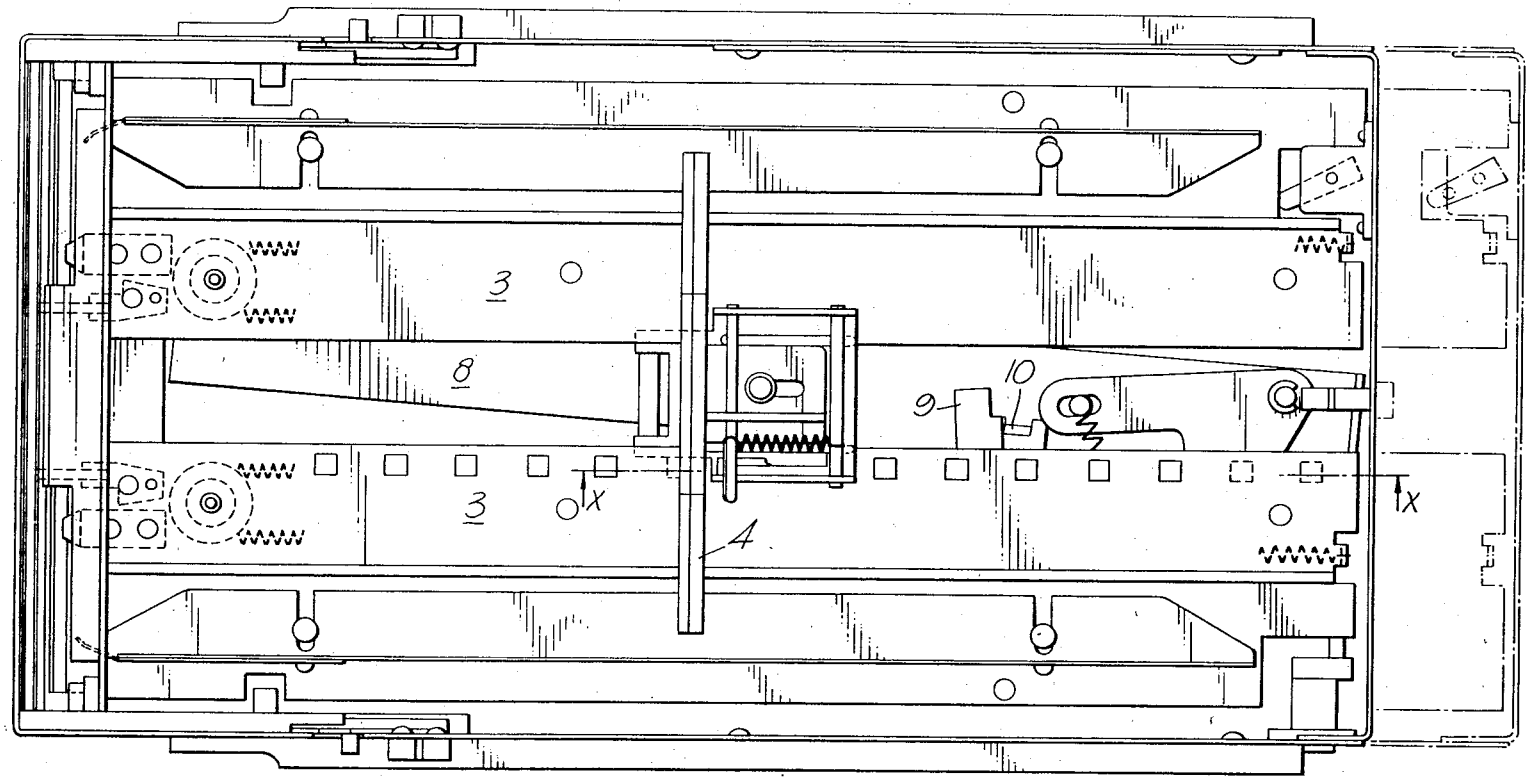
FIG. 3 is a plan view of the banknote cassette of FIG. 1, including the packer plate assembly and floors, and excluding the lid and hinge.

As shown in FIG. 3, which corresponds closely to FIG. 1, inner floors 3 are located immediately above the shutter locking mechanism, and support a stack of banknotes whose faces are parallel to the end walls of the cassette. A packer plate assembly 4 is mounted to slide along the inner floors 3, and is spring-biased towards the shutter end of the cassette to hold the stack of banknotes firmly in place. The banknote stack must be held only lightly, otherwise the delivery of individual banknotes would be impeded, yet the banknotes must not be deranged during the transport or rough handling of the cassette. A ratchet and pawl mechanism is used to maintain the position of the packing plate assembly, as shown more clearly in FIGS. 4 to 6. As the packing plate assembly 4 moves forward towards the banknote stack, a pawl 18 travels over a regular array of holes 3*a* provided in the inner floors 3, and finally engages one of the holes when the plate has met the stack S. A rack comprising a series of indentations could alternatively replace the array of holes. An extension on the pawl 18 allows the pawl manually to be held clear of the floor 3 as the packing plate assembly is slid back for reloading. To assist in the reloading of the cassette, with the lid 24 in the open position, the packer plate assembly 4 is held in its fully retracted position by means of a latch 25 on the end of the cassette which engages a pin 27 on the packer plate assembly 4. When the cassette is loaded and the lid 24 is closed, the latch 25 is pushed downwards against the action of a spring and the pin 27 is released, allowing the packer plate assembly 4 to spring back onto the stack S of banknotes. The packing plate latch 25 may alternatively be operated manually, and its automatic operation by the cassette lid 24 may be prevented by the removal of a block 26 from a pocket in the lid.

Figure 4:
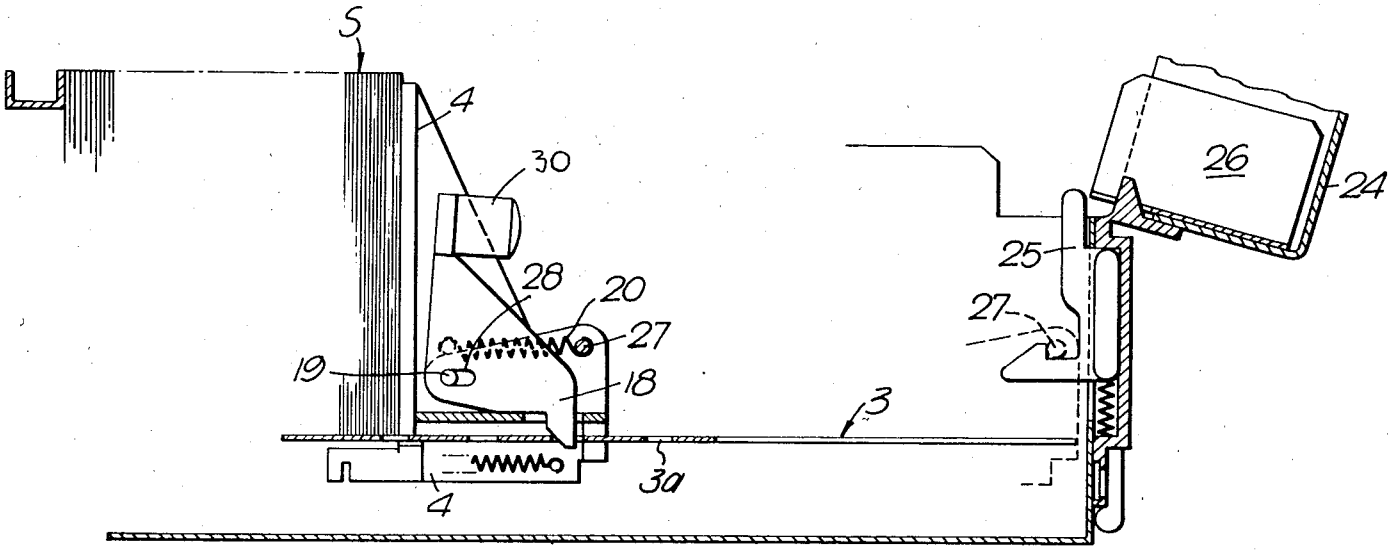
FIG. 4 is a section X—X of FIG. 3, showing as a sectional side view a stack of banknotes, the stacker plate assembly, and part of the cassette lid.

In the event of the cassette being only partially loaded, the packing plate assembly could fly forward under its spring pressure and pack the banknotes hard against the front of the cassette. If the pawl 18 then engaged immediately in a hole in the floor 3, the stack may be so compressed as to create feeding problems. To overcome this, the pawl 18 is provided with an elongate slot 28 through which extends a pin 19 of the packing plate assembly. A spring 20, which is normally used to bias the pawl 18 clockwise relative to the remainder of the packing plate assembly, not only functions to engage the pawl in the holes 3*a* in the floor, but also biases the pawl in a direction away from the banknote stack S, as shown in FIG. 4. When the pawl 18 engages in a hole 3*a*, as shown in FIG. 4, the stack S of banknotes is free to expand, and because the slot 28 is of elongate form the packing plate is pushed back, relative to the stationary pawl, to the position shown in FIG. 6. The degree of re-expansion of the stack S is thus limited by the length of the elongate slot 28 in the pawl 18.

Figure 5:
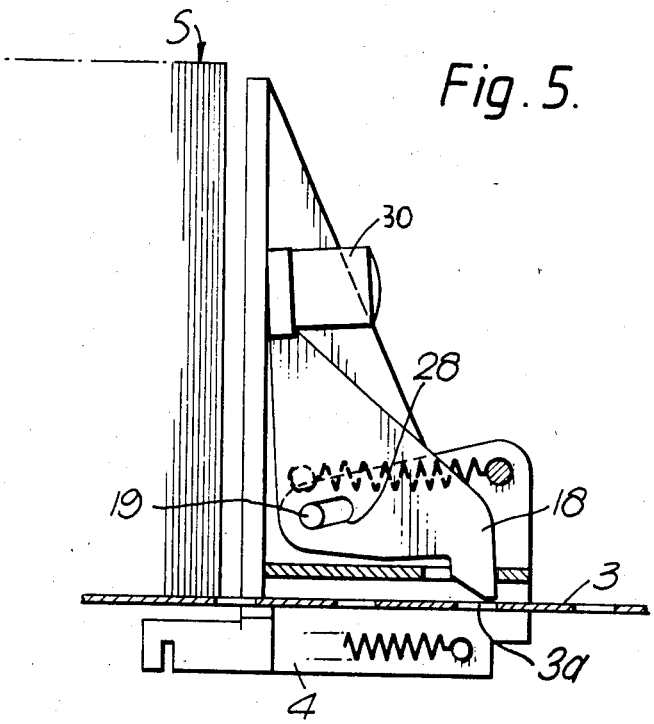
FIG. 5 shows the stacker plate assembly with the pawl raised as it is travelling towards the stack.
Figure 6:
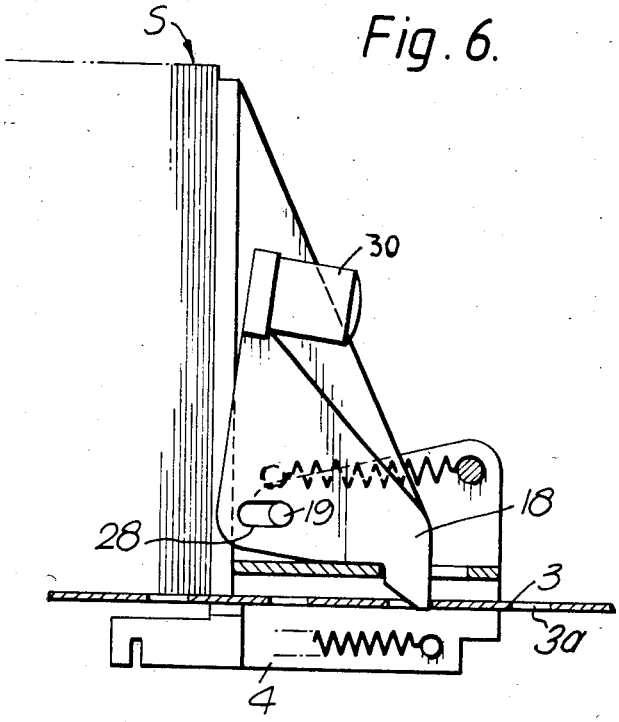
FIG. 6 shows the stacker plate assembly in its final position of rest, with the pawl engaged.

FIG. 5 illustrates how the pawl 18 is manually rotatable anti-clockwise about the pin 19 so as to release it from engagement in the hole in the floor 3, to enable the packing plate assembly to be retracted.

A counter weight 30 is mounted on the pawl 18. When a cassette loaded with a stack of notes is carried vertically, the stack of notes may bounce and cause the tooth of the pawl to move out of its aperture 3*a*. The counter weight greatly reduces bounding of the note stack when the cassette is carried front downward. In other position of the cassette, the counterweight assists in holding the tooth of the pawl in its aperture 3*a*.

I claim:

1. A secure container with a shutter for controlling access through an aperture to the contents of the container, and comprising:

a shutter-operating member coupled to the shutter and mounted for sliding motion in the container such that insertion of the container into a complementary housing causes the shutter-operating member to move within the container and open the shutter, the shutter operating member being formed with an aperature;

shutter locking means including a shutter locking bar mounted for pivotal movement between a primed position, in which one end of the shutter locking bar is aligned with the aperture in the shutter-operating member so as to allow the shutter operating member to slide down the shutter locking bar and open the shutter, and a locking position in which the said end of the shutter locking bar is out of alignment with the said aperture and prevents sliding movement of the shutter-operating member;

a lock with a lock pin cooperating with the shutter locking bar and movable between normal and priming positions, movement of the lock pin to the priming position causing the shutter locking bar to move to its primed position;

and an interlocking mechanism comprising a first part engaged by the lock pin when the lock pin is in its normal position and a second part connected to the first part and engaging the shutter locking means to prevent the movement of the shutter locking bar to its primed position when the first part is engaged by the lock pin.

2. A secure container in accordance with claim 1 wherein the shutter locking means includes a member coupled to the shutter locking bar and wherein the lock pin in its normal position lies between the first part of the interlocking mechanism and the said member coupled to the shutter locking bar and thereby prevents movement of the shutter locking bar until the lock pin is moved from its normal position, and wherein the said second part of the interlocking mechanism includes a lug engaging the said member coupled to the shutter locking bar, the pin being mounted on the lock for arcuate movement from its normal position to its priming position along a path such that it engages the shutter locking means to move the shutter locking bar to its primed position in which the shutter operating member is unlocked.

3. A secure container in accordance with claim 2, in which the interlocking mechanism is a pawl pivoted to the member forming part of the shutter locking means and such that upon return of the shutter locking means to its locking position, the pawl is carried by the said member back along a path such that it re-engages the locking pin and thereby relocks the container.

4. A secure container in accordance with claim 1, wherein the lock is operated by a key inserted through the container wall, the key being removable only with the lock pin in its normal position.

5. A secure container in accordance with claim 1, comprising a packer plate assembly slidable lengthwise along an internal floor and spring biased towards an end wall of the container, the assembly including a packer plate for holding a stack of banknotes in place against the said end wall.

6. A secure container in accordance with claim 5, wherein a regular line of apertures or indentations is formed on the floor in the travel path of the packer plate assembly, and the packer plate assembly includes a pawl for engaging the apertures or indentations with a ratchet action as the assembly slides towards the stack of banknotes, the pawl being releasable to allow the return movement of the assembly, the pawl being mounted on the remainder of the packer plate assembly with a degree of play in the lengthwise direction to allow limited return of the packer plate and consequent re-expansion of the stack upon engagement of the pawl in an aperture or indentation.

7. A secure portable, elongate container for baknotes comprising:

a secure housing with a floor, a lid through which the container is filled with a stack of banknotes, and an end wall having a shuttered aperture through which banknotes are dispensed individually;

a packer plate assembly slidable within the container in the direction of the length of the container and spring biased towards the said end wall, including a packer plate for holding the stack in place;

the floor of the housing being formed with apertures or indentations in a line extending in the said length direction;

and the packer plate assembly including a pawl and means for mounting the pawl on the remainder of the packer plate assembly for pivoting motion and for limited sliding motion with respect to the packer plate in the direction of the length of the container, the pivoting motion allowing the pawl to engage the said apertures or indentations with a ratchet action as the packer plate assembly slides towards the stack, the pawl being releasable to allow the return movement of the packer plate assembly, and the said mounting for limited sliding motion permitting the pawl a degree of play in the direction of the length of the container to allow limited return of the packer plate and consequent reexpansion of the stack upon engagement of the pawl in an aperature or indentation.

8. A secure container in accordance with claim 7, wherein the packer plate pawl is mounted on a pin in the packer plate assembly by means of an elongate slot parallel to the said travel path, the slot providing the said degree of play.

9. A secure container in accordance with claim 8, wherein the packer plate pawl is spring-biased, relative to the remainder of the packer plate assembly, away from the stack.

10. A secure container in accordance with claim 7, further comprising a latch for holding the packer plate assembly in a retracted position against the action of the biasing springs.

11. A secure container in accordance with claim 10, wherein the packer plate assembly latch is automatically released when the lid of the container is closed.

12. A secure container in accordance with claim 7, wherein a weight is mounted on the packer plate pawl to reduce the possibility of the pawl leaving the aperture or indentation during carrying of the container.

* * * * *